US006328618B1

(12) United States Patent
Fleischli

(10) Patent No.: US 6,328,618 B1
(45) Date of Patent: Dec. 11, 2001

(54) COMBINATION LIFEJACKET AND PROTECTIVE BODY HEAT RETAINING POD

(76) Inventor: Jack A. Fleischli, 3518 Cahuenga Blvd. West, Suite 310, Los Angeles, CA (US) 90068

( * ) Notice: Subject to any disclaimer, the term of this patent is extended or adjusted under 35 U.S.C. 154(b) by 0 days.

(21) Appl. No.: 09/609,674

(22) Filed: Jul. 3, 2000

(51) Int. Cl.[7] ..... B63C 9/12

(52) U.S. Cl. ..... 441/106; 441/80; 441/88; 441/102; 441/103; 441/104; 2/456

(58) Field of Search ..... 441/106, 102, 441/103, 104, 80, 88, 84, 90, 94, 105, 117; 2/2.15, 202, 456, 458, 462

(56) References Cited

U.S. PATENT DOCUMENTS

| | | | | |
|---|---|---|---|---|
| 4,023,223 | * | 5/1977 | Anderson et al. | 2/2.15 |
| 4,272,857 | * | 6/1981 | Oldham | 441/92 |
| 4,673,366 | * | 6/1987 | Hawkins | 441/90 |
| 4,685,890 | * | 8/1987 | Edwards | 441/94 |
| 4,722,710 | * | 2/1988 | Hagen et al. | 441/103 |
| 4,740,183 | * | 4/1988 | McKenzie | 441/104 |
| 4,753,621 | * | 6/1988 | Lucas et al. | 441/117 |
| 5,067,921 | * | 11/1991 | Bramham | 441/102 |
| 5,702,279 | * | 12/1997 | Brown | 441/108 |
| 5,736,954 | * | 4/1998 | Veazey | 441/89 |
| 5,855,497 | * | 1/1999 | French | 441/84 |
| 5,953,750 | * | 9/1999 | Stella | 2/2.15 |
| 6,203,390 | * | 3/2001 | Elliott | 441/80 |
| 6,206,744 | * | 3/2001 | Wigutow | 441/88 |

* cited by examiner

*Primary Examiner*—S. Joseph Morano
*Assistant Examiner*—Lars A. Olson
(74) *Attorney, Agent, or Firm*—Morland C. Fischer

(57) ABSTRACT

A protective body heat retaining pod that is carried in a folded condition within a pod containment envelope at the rear of a personal floatation device (i.e. a lifejacket) so as to be accessible to and worn over the lifejacket by both civilian and military personnel who find themselves in or about to enter a cold water environment while awaiting rescue from an emergency situation. A hood to be pulled over the head of the wearer is carried in a rolled up condition within a fold-over collar of the lifejacket. The protective pod creates a sealed chamber around the wearer within which a small volume of water is trapped and heated by the wearer's body heat to slow a drop in the wearer's body temperature to better enable him to survive his environment while awaiting rescue. A cinching cord attached to the bottom of the protective pod is pulled upwardly by the wearer, whereby the protective pod is correspondingly pulled upwardly to draw and hold the wearer's legs in a fetal position in order to reduce the size of the chamber and thereby minimize the volume of water to be trapped and heated therewithin.

30 Claims, 14 Drawing Sheets

COMBINATION LIFEJACKET AND PROTECTIVE BODY HEAT RETAINING POD

BACKGROUND OF THE INVENTION

1. Field of the Invention

This invention relates to a protective pod that is carried in a folded condition within a pod containment envelope at the rear of a personal flotation device (i.e. lifejacket) so as to be accessible to and worn by a civilian and military airman or a seaman who finds himself in or about to enter a cold water environment while awaiting rescue from an emergency situation. The protective pod creates a sealed chamber within which a small volume of water is trapped and heated by the wearer's body heat to slow a drop in the wearer's body temperature to better enable him to survive his environment.

2. Background Art

As may occur in an emergency situation, a civilian (e.g. a boater, a cruise ship passenger, a pilot, etc.) or a member of the military may find it necessary to abandon his boat or plane. In cases where a boat is at sea or an airplane is above a body of water, the individual may have to enter the water while awaiting rescue. Where the individual must enter a cold water environment wearing nothing more than a conventional lifejacket, his body temperature will quickly drop to a level where survival becomes impossible if his rescue is delayed for any prolonged period of time.

Waterproof garments are known that offer some protection to a wearer against hypothermia and the effects of low temperature, such as that which would be encountered by civilians or military personnel who face an emergency situation while at sea. However, these garments are typically worn in lieu of a lifejacket or other conventional personal floatation device. Accordingly, the wearer will quickly tire and/or have trouble staying afloat while awaiting his rescue. Moreover, the ability of many garments to insulate the wearer's body against a significant drop in temperature may be negligible. That is, garments such as clothing do not fully surround and protect the wearer's body and/or function as a warming device, such that the wearer may find himself facing hypothermia after a relatively short time in the cold water environment. Consequently, the wearer's chances of survival will be relatively minimal, especially where the water temperature is low and the time to await rescue is more than a few minutes.

Moreover, heavily insulated and independently buoyant garments, known generically as immersion or survival suits, are typically expensive, high-end emergency garments that are used by commercial fishermen and oil rig workers, where the chances of unexpected immersion in a cold water environment are high and the high per person cost of the immersion suit is not deemed cost prohibitive. The immersion or survival suits would not usually be considered appropriate nor cost effective for most private non-commercial, recreational boaters, commercial cruise ship passengers and even highly mobile military personnel where the bulk and weight of hypothermia protective devices would be a serious consideration.

Therefore, what is needed is a reliable protective enclosure that is capable of slowing the effects of hypothermia and thereby prolonging the survivability of a user while fully immersed in a cold water environment, without being so cost prohibitive or so heavy and bulky that it would not be of practical use and commercial value.

Examples of protective garments, and the like, that can be used to increase the wearer's chances of surviving a cold water environment are available by referring to one or more of the following United States patents:

| | | |
|---|---|---|
| 3,744,053 | Parker et al | July 10, 1973 |
| 4,533,333 | Andrew et al | August 6, 1985 |
| 4,533,335 | Hoshino | August 6, 1985 |
| 4,739,522 | Lassiter et al | April 26, 1988 |

SUMMARY OF THE INVENTION

Disclosed below is a protective pod which is capable of significantly retarding the loss of a wearer's body heat. The pod can be worn by a civilian or military seaman or airman who must enter a cold water environment while awaiting rescue from an emergency situation. The protective pod is preferably manufactured from a readily foldable, highly water resistant ripstop nylon material with urethane backing. In this regard, and prior to its deployment, the protective pod is carried in a folded or rolled up condition within a pod containment envelope at the back of a personal floatation device (commonly known as a lifejacket). The protective pod is always and only worn in combination with the lifejacket, but not in substitution thereof. For non-military use, the personal floatation device would be a Type I, II or III personal floatation device (as defined by 46 Code of Federal Regulations Section 160 et. Seq.). The pod containment envelope of the lifejacket is formed by a series of flaps that are folded over one another to enclose the protective pod. A rip cord that is attached to the flaps inside the containment envelope is manually accessible so as to be grasped and pulled by the wearer to cause the containment envelope to open and the protective pod in its collapsed condition to fall out to permit deployment whether the wearer has already entered or is about to enter the water. The protective pod is connected to the lifejacket by means of a detachable tether so as to prevent the pod from sinking or otherwise drifting out of reach from the user. A hood to be worn over the head of the wearer is stored in a rolled up condition within a foldover collar that runs around the top of the lifejacket. The wearer simply lifts up on the collar to grab and remove the hood therefrom. After it is unrolled, the hood is pulled over the wearer's head and held snugly there against by pulling a drawstring and closing a chin flap.

The wearer dons the protective pod by inserting his legs and torso into a body portion thereof. Thereafter, the user inserts his arms and hands through watertight sleeves. The user pulls the protective pod up around the lifejacket and then zips up a heavy grade zipper extending vertically along the front of the protective pod. There is a cinching cord running through a channel around the top of the protective pod which the user pulls to close the pod snugly around the foldover collar of the lifejacket. A Type I, II or III personal floatation device is designed to be buoyant so that the water line is below the lifejacket collar. The user then pulls upwardly on a pair of vertically extending cinching cords that are attached to a seam along the bottom of the protective pod to draw his legs up into a fetal-type position to facilitate body heat retention. Pulling upwardly on the cinching cords causes the protective pod to be effectively shortened so as to also minimize the volume of water that will be trapped inside the protective pod. Minimizing the volume of water inside the protective pod directly enhances the warming of that water by the body heat of the wearer and thereby inhibits and slows the loss of the wearer's body heat, thus prolonging his survivability while immersed in the cold water environment awaiting rescue. As the final step in donning the protective pod, the wearer uses a hook and loop fastener closure to secure a wrap around collar located at the top of the protective pod in a snug position outside the hood and around the collar of the lifejacket so as to be crossed over and attached to the pod in front of his neck to minimize the opportunity for outside water to enter the interior of the pod.

DETAILED DESCRIPTION

Figure 1:
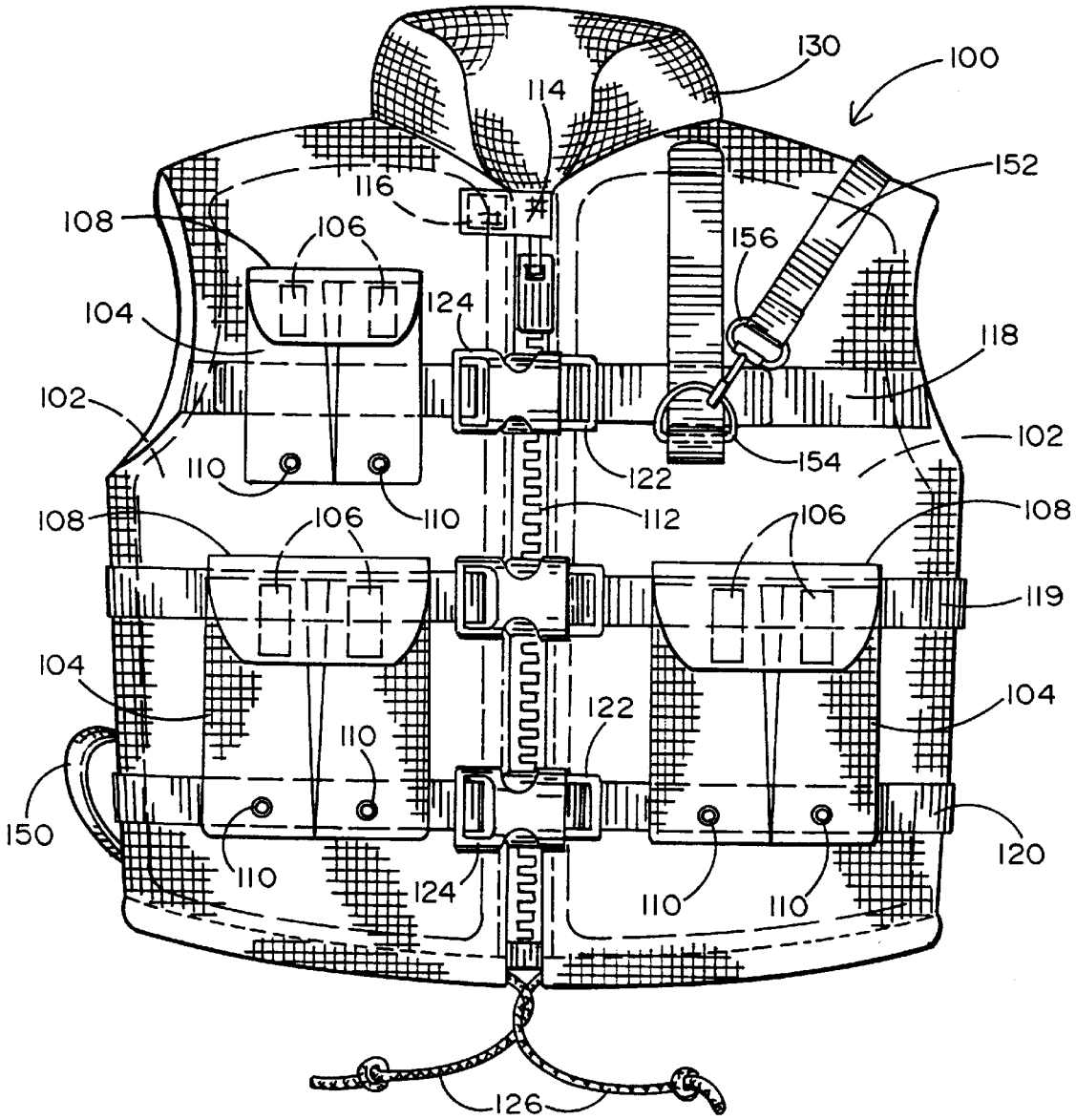
FIG. 1 shows the personal floatation device (i.e. lifejacket) that is worn in combination with the protective body heat retaining pod to form the present invention.

The combination lifejacket and protective body heat retaining pod which forms the present invention is described while referring initially to FIGS. 1–11 of the drawings where details of a unique personal floatation device (i.e. commonly known as a lifejacket 100) are disclosed. As will be described in greater detail hereinafter, both the lifejacket 100 and the soon to be described protective pod (designated 1 in FIGS. 12–16) are worn, one over the other, by civilian or military personnel who find themselves in a cold water environment while awaiting rescue from an emergency situation. For non-military use, the lifejacket 100 illustrated at FIGS. 1–11 is a Type I, II or III personal floatation device pursuant to 46 C.F.R. 160 et seq. Thus, lifejacket 100 is manufactured so as to be buoyant to maintain the water line below the lifejacket collar 130 which surrounds the neck of the wearer. As will also be described in greater detail below, the protective pod 1 is efficiently folded into a compact package and carried within a pod containment envelope (designated 132 in FIGS. 2–4) at the rear of the lifejacket 100. As an important advantage of this invention, the protective pod 1 is stored within the pod containment envelope 132 so as to be readily available to the wearer and easily deployed in an emergency situation in order to provide the wearer with the ability to prolong his survival while awaiting rescue in a cold water environment.

Figure 2:
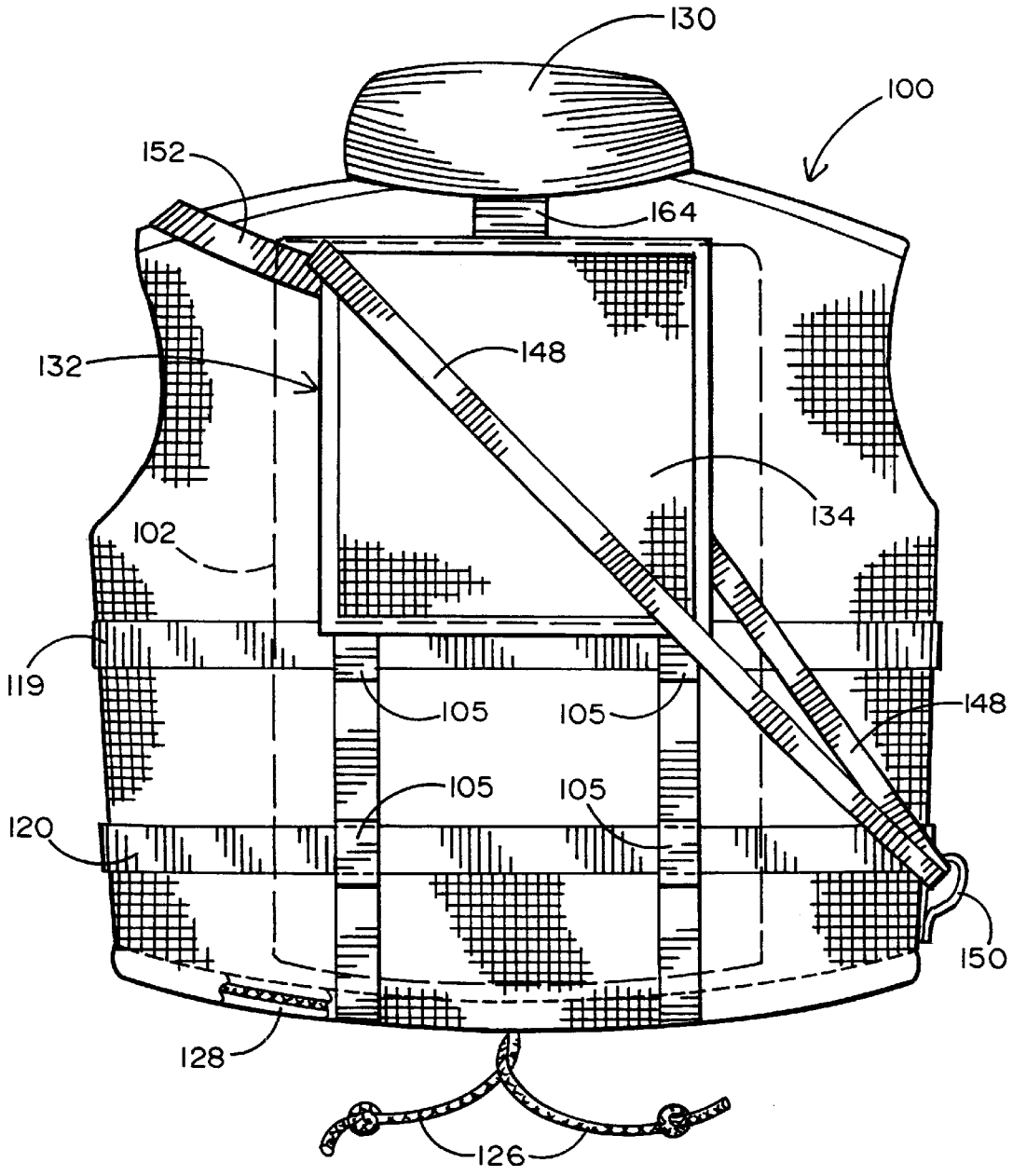
FIG. 2 shows the rear of the lifejacket of FIG. 1.
Figure 3:
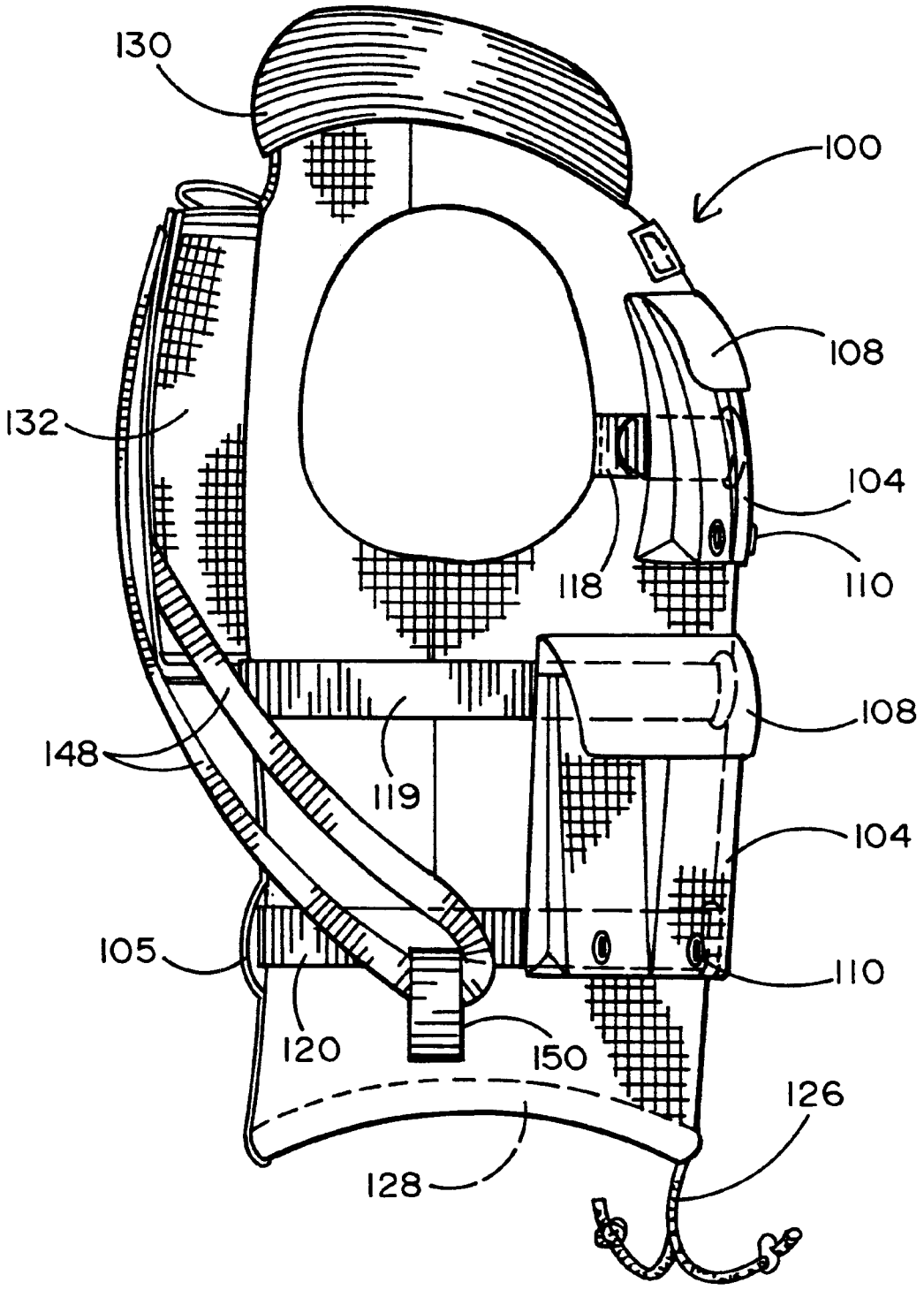
FIG. 3 shows a side view of the lifejacket of FIG. 1.

The lifejacket 100 shown in FIGS. 1–3 is manufactured from a lightweight, water resistant material. As is best shown in FIGS. 1 and 2, a plurality of floatation foam pads 102 are carried within interior compartments at the front and rear of lifejacket 100 to provide the wearer with the buoyancy necessary to remain afloat while drifting in the water. A suitable number of pockets 104 are sewn to the front of the lifejacket 100. The pockets 104 are closed by means of opposing strips 106 of complementary and well known hook and loop fastener material that are located under the flaps 108 and over the top of the pockets 104. A number of ports 110 are formed through each of the pocket 104 to enable sea water to escape therefrom.

The lifejacket 100 is closed around the body of the wearer by a vertically extending, heavy grade zipper 112. To hold the zipper 112 closed, a tab 114 at the top of lifejacket 100 is detachably retained across the top of the zipper by means of opposing strips 116 of complementary hook and loop fastener material. To ensure a snug fit of the lifejacket 100 against the body of the wearer, upper, intermediate and lower tightening straps 118, 119 and 120 extend horizontally around the lifejacket. As is best shown in FIGS. 2 and 3, the tightening straps 118–120 are tunneled under the aforementioned pockets 104 at the front of lifejacket 100 and supported by loops 105 at the rear of the lifejacket. Opposing ends of the tightening straps 118–120 at the front of the lifejacket 100 have conventional, push-button actuated, snap and catch fastener members 122 and 124 that are detachably connected to one another to hold the straps together.

A drawstring 126 is located within a hollow channel (designated 128 in FIG. 2) that runs circumferentially around the bottom of the lifejacket 100. By pulling on opposite free ends of the drawstring 126, the lifejacket 100 will be tightened around the waist of the wearer. It may be appreciated that the vertically extending zipper 112 as well as the horizontally extending tightening straps 118–120 and drawstring 126 cooperate to hold the life vest 100 close to the wearer's body so as to reduce the loss of the wearer's body heat and keep the wearer's body positioned high in relation to the waterline.

An important detail of the lifejacket 100 of this invention is a foldover collar 130 that surrounds the top of the lifejacket to fit around the wearer's neck. As will be described when referring to FIGS. 6–11, the collar 130 is unfolded to permit the wearer to gain access to a hood (designated 160 in FIGS. 8–11) that is stored in a rolled up condition within the collar 130. Another important detail of the lifejacket 100 is the previously mentioned pod containment envelope 130 which is located at the rear of lifejacket 100 to enclose the protective body heat retaining pod 1 that is stored in a folded condition within envelope 132 prior to deployment.

Referring concurrently to FIGS. 1–5 of the drawings, the pod containment envelope 132 includes a top flap 133, a bottom flap 134, a rear flap 135, and a pair of opposite side flaps 136 and 137 which, in the packaged position of FIGS. 2 and 3, are folded over one another to enclose the protective pod 1 and thereby facilitate the storage and transport thereof at a non-obtrusive location at the rear of lifejacket 100. The rear flap 135 is affixed to the back of the lifejacket 100, and the top flap 133, the bottom flap 134 and the side flaps 136 and 137 are all pivotally attached (e.g. sewn) to respective ends of the rear flap 135 so that in the unpackaged position of FIG. 5, the containment envelope 132 will be opened to cause the protective pod 1 to fall outwardly therefrom so as to become accessible to the wearer.

Figure 4:
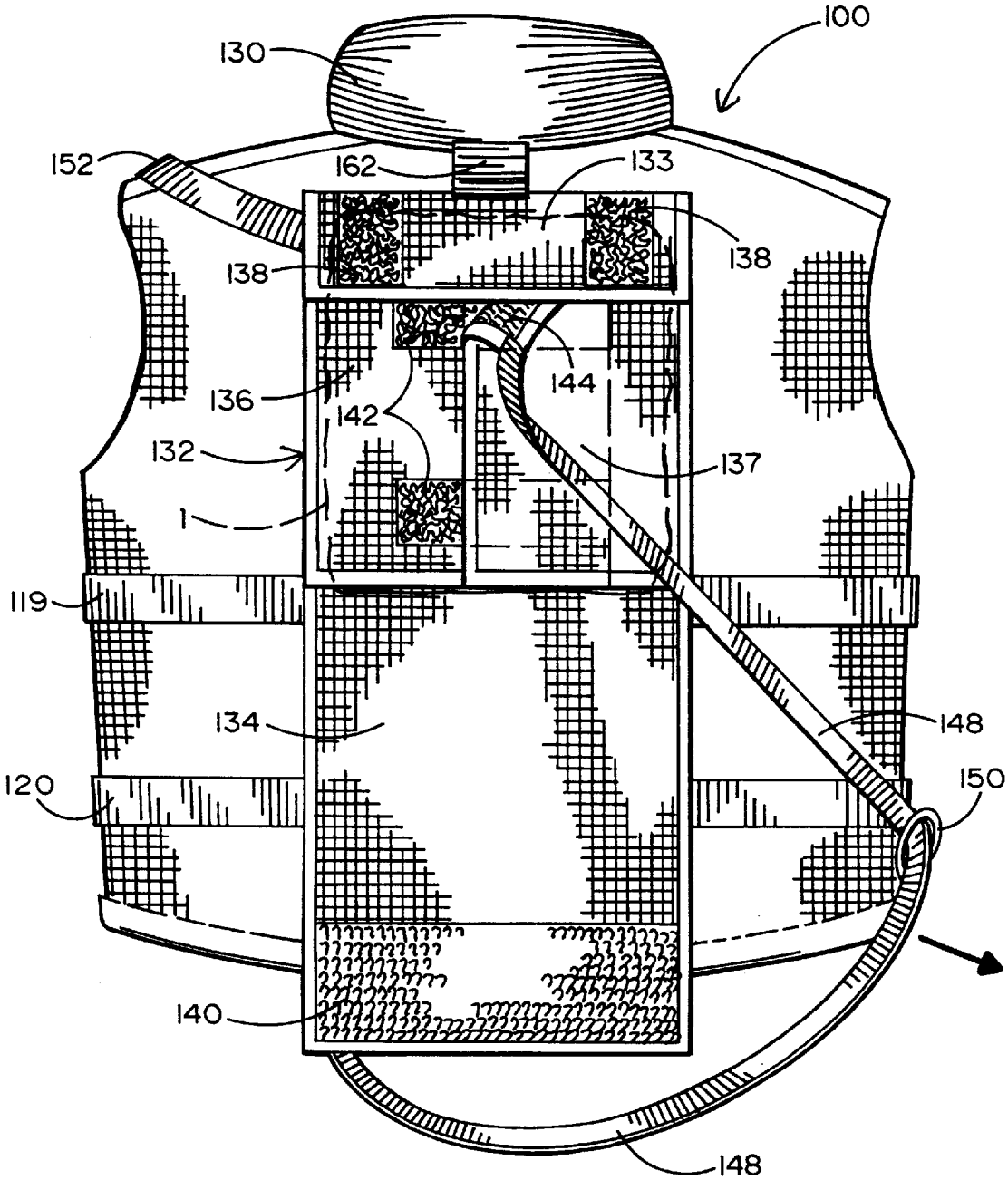
FIGS. 4 and 5 show the pod containment envelope located at the rear of the lifejacket in which to enclose the protective body heat retaining pod in a folded condition.
Figure 5:
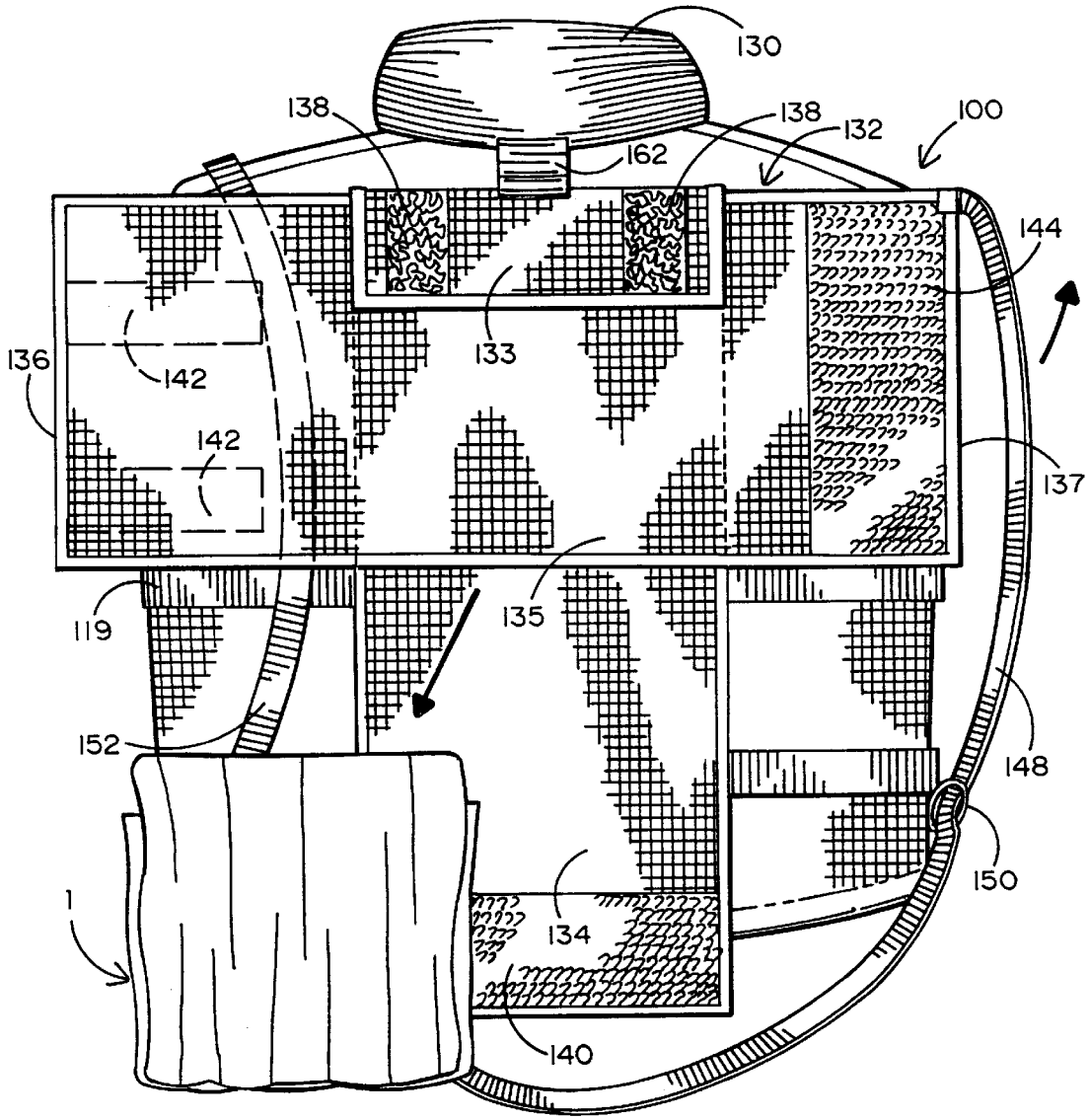
Figure 6:
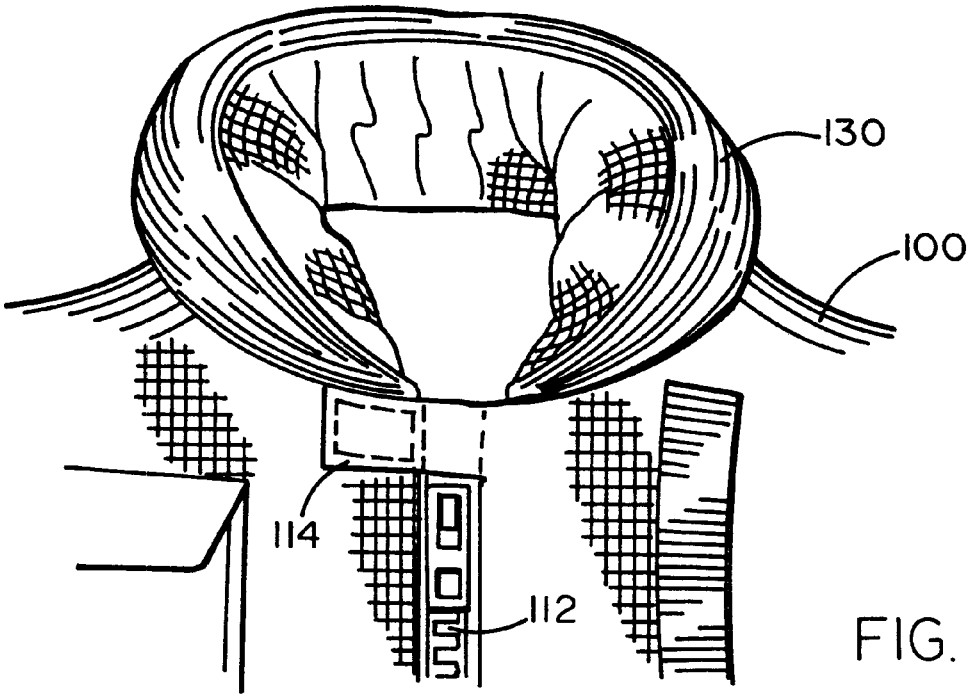
FIGS. 6–8 show a foldover collar extending around the top of the lifejacket within which to carry a hood in a rolled up condition.
Figure 7:
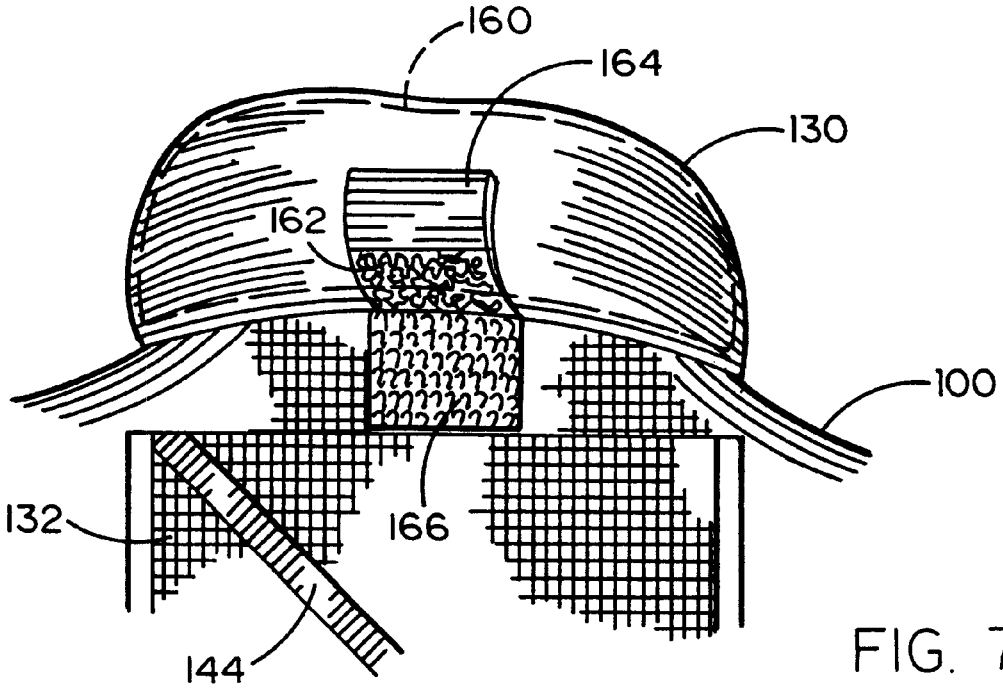

As is best shown in FIG. 5, in order to hold the pod containment envelope 132 in the packaged position in surrounding engagement with the protective pod 1 at the rear of lifejacket 100, strips 138 of hook fastener material are affixed to the outside of the top flat 133, an opposing strip 140 of complementary hook fastener material is affixed to the inside of the bottom flap 134, strips 142 of loop fastener material are affixed to the outside of one side flap 136, and a strip 144 of complementary hook fastener material is affixed to the inside of the opposite side flap 137. To manipulate the pod containment envelope 132 to the packaged position as shown in FIG. 4, the folded protective pod 1 is first laid upon the rear flap 135. The side flap 136 is then folded over the protective pod 1 to expose the strips 142 of loop fastener material. Next, the opposite side flap 137 is folded over side flap 136, such that the strips 142 and 144 of complementary hook and loop fastener material are moved into mating engagement. Lastly, the top flap 136 is folded downwardly over the side flap 137, and the bottom flap 134 is folded upwardly over the top flap 133, such that the strips 138 and 140 of complementary hook and loop fastener material are moved into mating engagement.

To open the pod containment package from the packaged to the unpackaged position, a manually accessible rip cord 148 is provided to enable the wearer to gain access to the protective pod 1 that is folded and stored within the containment envelope 132 at the rear of the lifejacket 100. The rip cord 148 extends from a corner of the side flap 137 of containment envelope 132, through a guide loop 150 that is affixed to a side of the lifejacket 100, and to a corner of the bottom flap 134. Inasmuch as the bottom flap 134 is the outermost flap of the pod containment envelope 132, the application of a pulling force against the ripcord 148 causes the bottom and the side flaps 134 and 137 to unfold and the containment envelope 132 to correspondingly open, whereby the protective pod 1 will drop out in the manner illustrated at FIG. 5. The guide loop 150 holds the rip cord 144 close to the side of lifejacket 100 so that the rip cord can be easily located, grasped and pulled by the wearer.

Once the pod containment envelope 132 is opened, it is desirable to prevent the protective pod 1 from either sinking or floating away from the wearer. To this end, a detachable tether 152 extends from the front of pod 1 (best shown in FIG. 12), over the wearer's shoulder, to a plastic D-ring 154 that depends from the upper tightening strap 118 at the front of lifejacket 100. Simple spring action clips 156 can be used to couple opposite ends of the tether 152 to the protective pod 1 and to the D-ring 154 of the lifejacket 100. In this same regard, the wearer can quickly disconnect the tether 152 once he has hold of the protective pod 1 and is ready to begin the deployment thereof while in the cold water environment.

Turning to FIGS. 6–11 of the drawings, the deployment of the hood 160 is now described after the wearer dons the lifejacket 100 of FIGS. 1–3. As previously disclosed, the hood 160 is carried in a rolled up condition within the foldover collar 130 at the top of lifejacket 100. A portion of the hood 160 is affixed to the lifejacket 100 below the collar 130. The collar 130 is initially folded over itself and closed against the lifejacket 100 by means of the mating engagement of a strip 162 of loop fastener material along a tab 164 at the rear of collar 130 and an opposing strip 166 of hook fastener material at the rear of the lifejacket 100 above the pod containment envelope 132. To remove the hood 160, the wearer first lifts up on the tab 164 to break the engagement between the opposing strips 162 and 166 of complementary hook and loop fastener material (best shown in FIG. 7).

Figure 8:
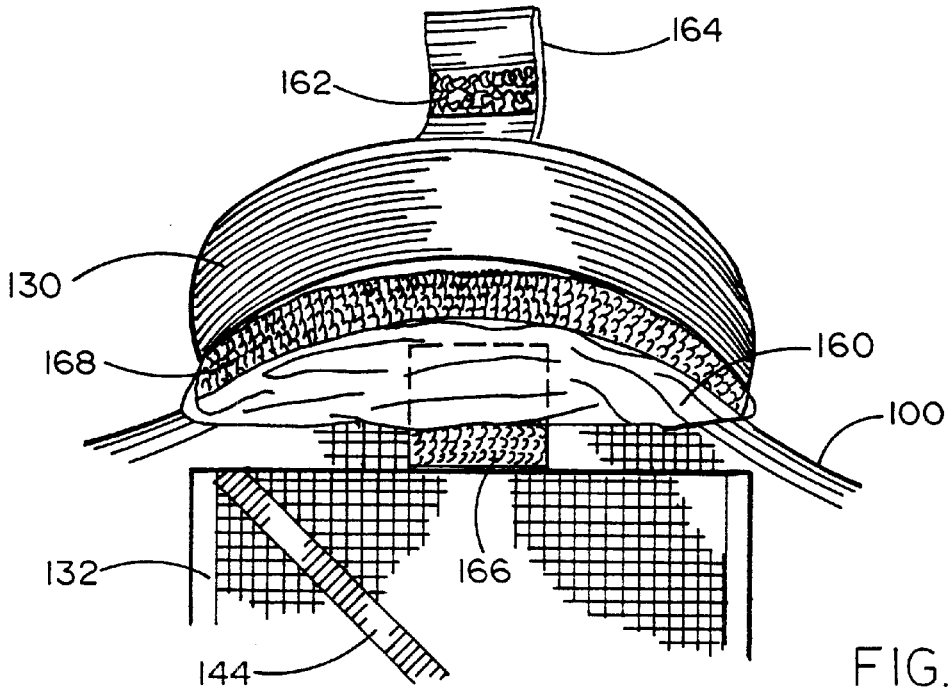
Figure 9:
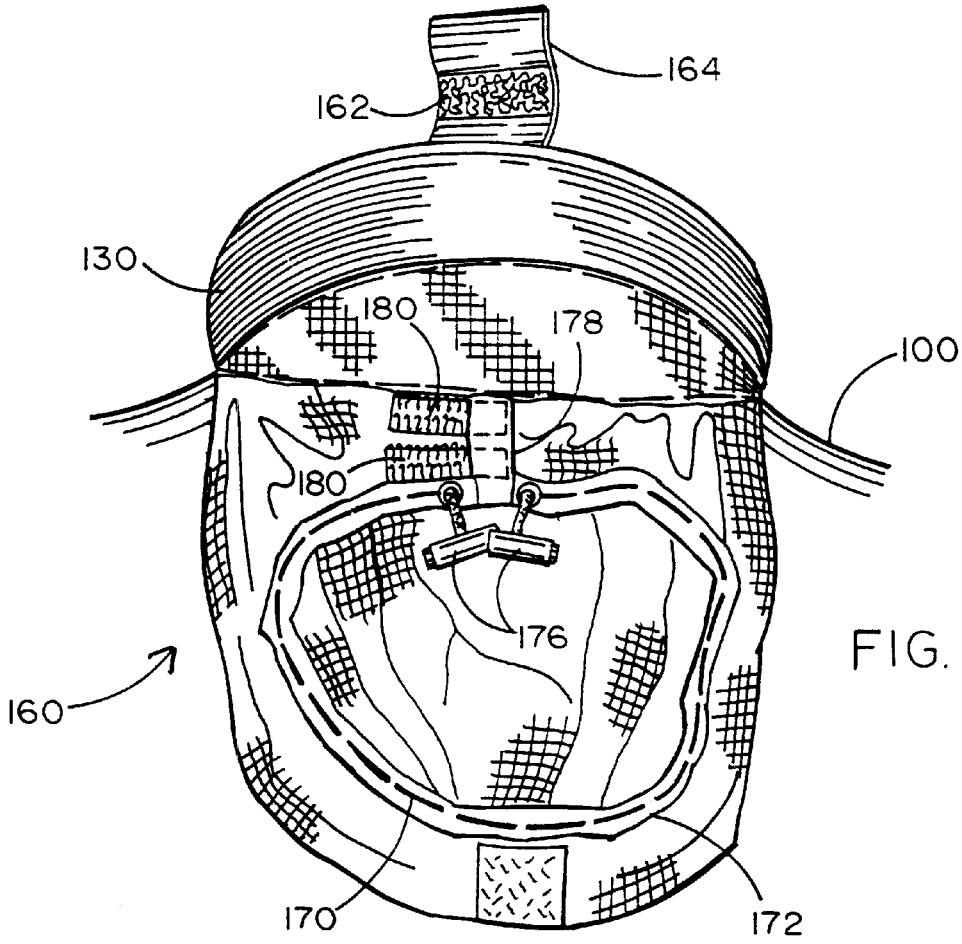
FIG. 9 shows the hood in the unrolled condition after it is removed from the collar of FIGS. 6–8.
Figure 10:
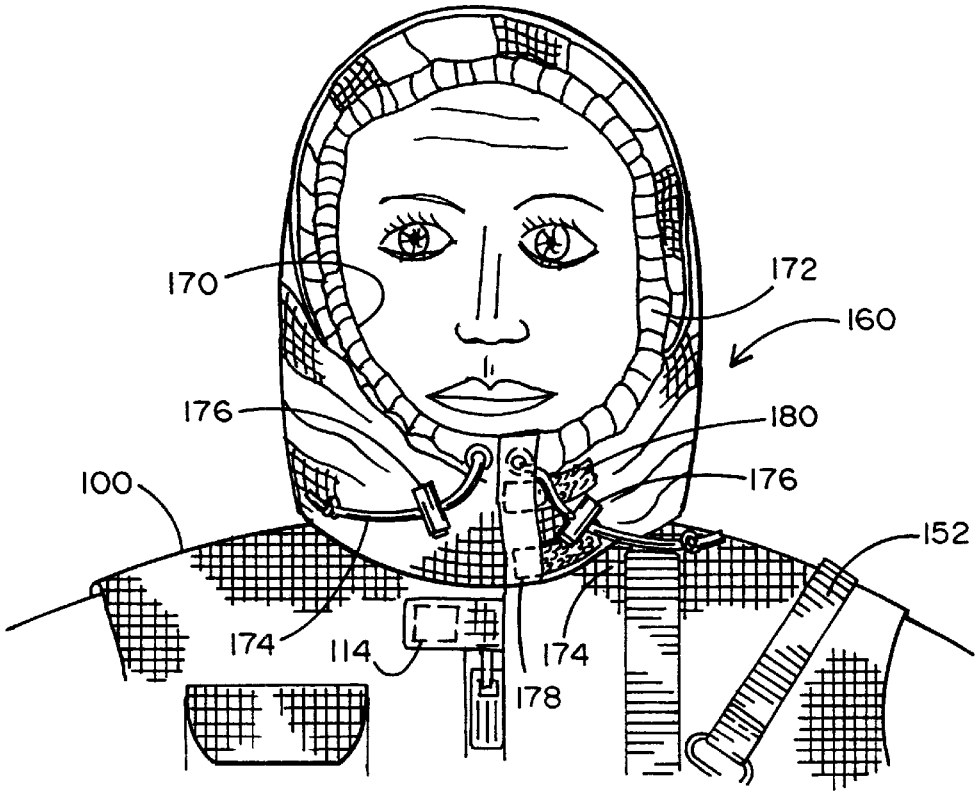
FIGS. 10 and 11 show the hood surrounding and being tightened against the head of a wearer.
Figure 11:
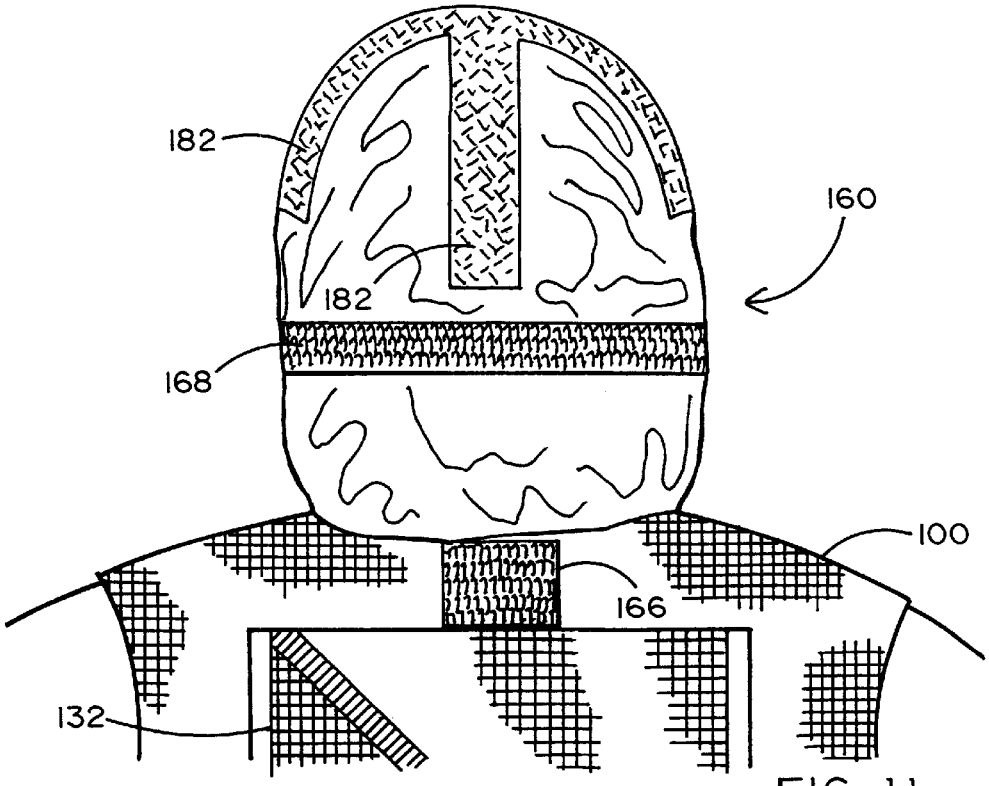

In FIG. 8, the wearer grasps the foldover collar 130 at the rear of the lifejacket 100 and pulls upwardly thereon. The wearer can now grab and pull the rolled up hood 160 out from the collar 130. In FIG. 9, the hood 160 is shown removed and unrolled from the collar 130 and hanging down the back of the lifejacket 100 so as to be ready to be pushed towards the front of the wearer and pulled over the wearer's head, as shown in FIG. 10 and 11. In its unrolled condition of FIG. 9, a horizontally extending strip 168 of hook material (best shown in FIGS. 8 and 11) runs around the back of the hood 160 for a purpose that will soon be described. Opposite the strip 168, an open window 170 is located in the front of the hood 160 to surround the face of the wearer in the manner shown by FIG. 10. A channel 172 extends around the periphery of the window 170, and a draw string 174 runs through the channel. By pulling on the opposite free ends of the drawstring 174, the wearer can tighten the window 170 around his face to prevent water from readily splashing to the inside of the hood 160. Each end of the drawstring 174 is associated with a conventional push button actuated cord stopper 176 (best shown in FIGS. 9 and 10) which is a tightening device that prevents the drawstring from sliding back into the channel 172 so as to avoid a loosening of the window 170 after the window has been tightened around the wearer's face.

As is best shown in FIGS. 9 and 10, a chin flap 178 is closed against the hood 160 by means of the mating engagement of opposing strips (only one of which 180 being shown) of complementary hook and loop fastener material. By virtue of pulling drawstring 174 and closing chin flap 178, the hood fits snugly over the wearer's head and around the wearer's face to further prevent the escape of the wearer's body heat. To facilitate a rescue team finding the wearer during both daylight and evening conditions, strips of light reflecting tape 182 are affixed over the top of the hood 160 (best shown in FIG. 11). A suitable reflecting tape 182 that is adapted to reflect both sunlight and moonlight and is suitable to be affixed to the hood 160 is that manufactured by the 3M Company under the commercial name SOLAS.

Turning to FIGS. 12–16 of the drawings, the protective body heat retaining pod 1 of the present invention is described in the unfolded condition following its removal from the pod containment envelope 132 at the rear of the lifejacket 100 in FIG. 5. The protective pod 1 is manufactured from a durable, lightweight material that is capable of being folded to enable a civilian or military seaman or airman who wears the pod 1 and finds himself in a cold water environment to survive the conditions of his environment while awaiting rescue. By way of example only, the protective pod 1 is constructed from a water resistant ripstop nylon with a urethane backing. Some or all of the pod 1 may be brightly colored to help locate a wearer who is awaiting rescue in the water following his evacuation from a boat or a plane.

Figure 14:
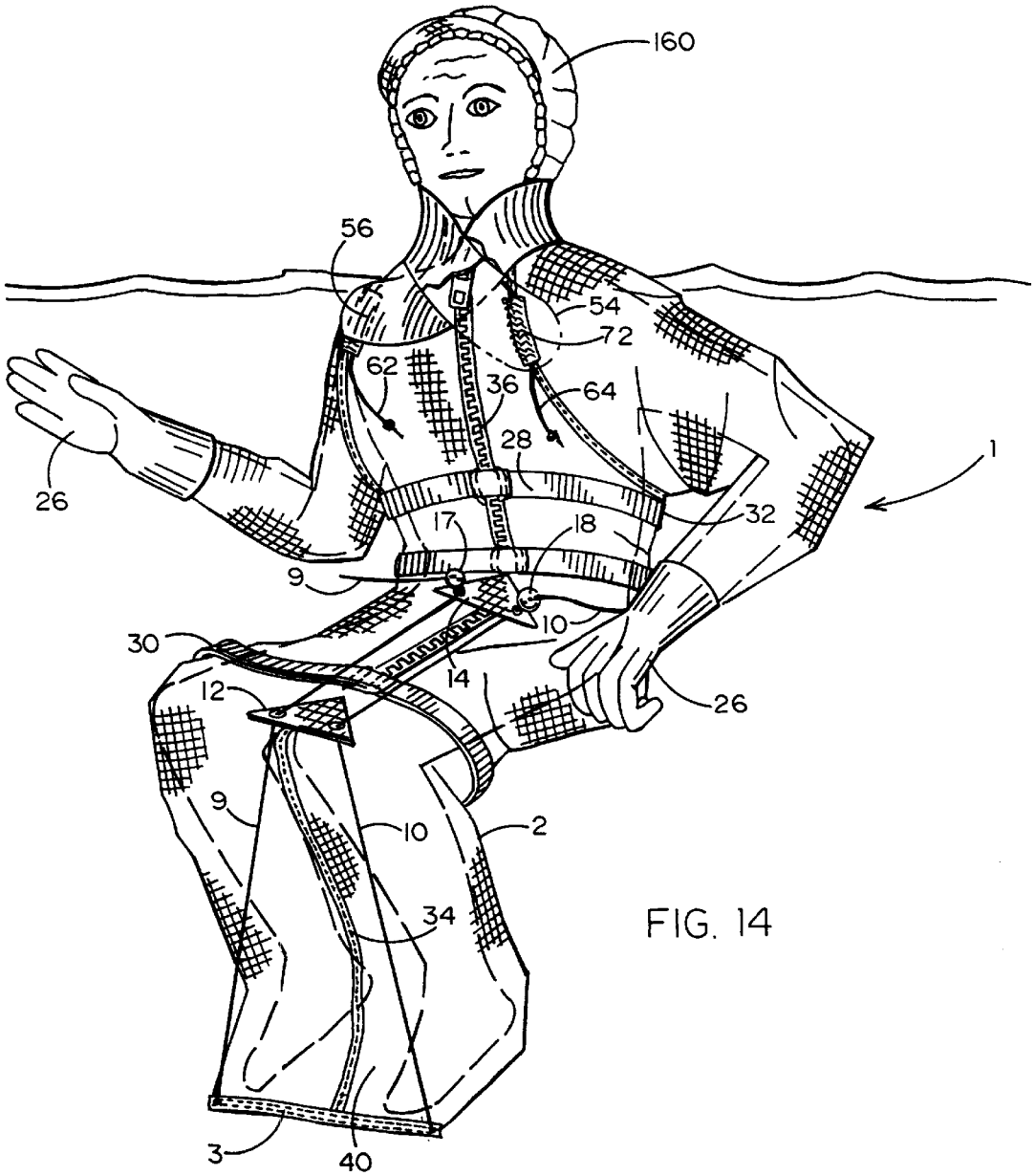
FIG. 14 shows the wearer in a fetal position within the protective pod such that a sealed envelope is established within which a relatively small volume of water is trapped and heated by the wearer's body heat to inhibit the loss of life sustaining warmth.
Figure 15:
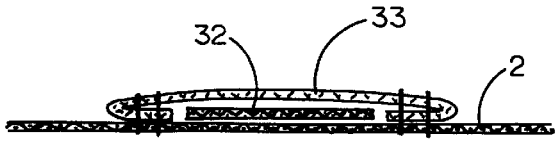
FIG. 15 is a cross section taken along lines 15—15 of FIG. 13.

The protective pod 1 is an enclosure having a body portion 2 that is adjustably sized to surround the torso and legs of a wearer (e.g. either an adult or a child). As described above, the protective pod 1 is used in combination with and not in lieu of the lifejacket 100 shown in FIGS. 1–3. Thus, after the wearer dons the protective pod 1, the lifejacket 100 will perform its usual function of keeping the wearer afloat. A closure 3 runs along the bottom of the body portion 2 to seal the pod 1 from its water filled environment. Therefore, and as an important feature of the protective body heat retaining pod 1, when the pod is worn in a water filled environment (as shown in FIG. 14), a small amount of water will remain trapped within a water tight chamber 40 of the body portion 2 lying below the waterline. This water within the chamber 40 of body portion 2 will eventually be heated by the body heat of the wearer so a to inhibit the loss of life sustaining warmth while the wearer awaits his rescue.

In some situations, the body portion 2 of protective pod 1 will be too long to comfortably surround and enclose the legs of the wearer. In this case, a relatively large volume of water could be undesirably trapped within the chamber 40 of the body portion 2 that lies below the water line. This large volume of water would be less efficiently heated by the wearer, resulting in a rate of body heat loss which would increase in relation to the increase in water volume. It is well known that a person immersed in cold water may reduce body heat loss, in part, by assuming an upright fetal position to further conserve body heat.

Accordingly, to minimize the volume of water that can be trapped within the body portion 2 and thereby reduce the loss of body heat from the wearer, means are provided to effectively shorten the length of the body portion 2 of the protective pod 1 to correspond with the size of the wearer by drawing the wearer's feet markedly upward and into the fetal position shown in FIG. 14. To accomplish the foregoing, a pair of vertical cinching cords 9 and 10 extend from eyelets in the closure 3 along the bottom of the body portion 2 and through respective openings in lower and upper guide tabs 12 and 14 that are stitched to and depend from the front of the body portion 2 at the base of a soon to be described zipper 36. The guide tabs 12 and 14 are arranged in spaced vertical alignment one above the other with the upper guide tab 14 disposed at about the midpoint of the body portion 2.

Each of the free ends of the cinching cords 9 and 10 which project from the upper guide tab 14 is fed through a push bottom actuated cord stopper 17 and 18 (similar to the cord stopper 176 that were described when referring to FIGS. 9 and 10). The cord stoppers 17 and 18 are tightening devices that have holes through which the vertical cinching cords 9 and 10 are adapted to slide. Each stopper 17 and 18 also has a pair of push button actuated jaws (not shown) that are normally clamped around a cinching cord 9 or 10 to prevent the cinching cord from sliding through the holes in the first and second guide tabs 12 and 14. When the push button of a cord stopper is depressed, the jaws thereof are temporarily opened to enable the cinching cord 9 and 10 to slide relative to the upper and lower guide tabs 12 and 14.

Figure 12:
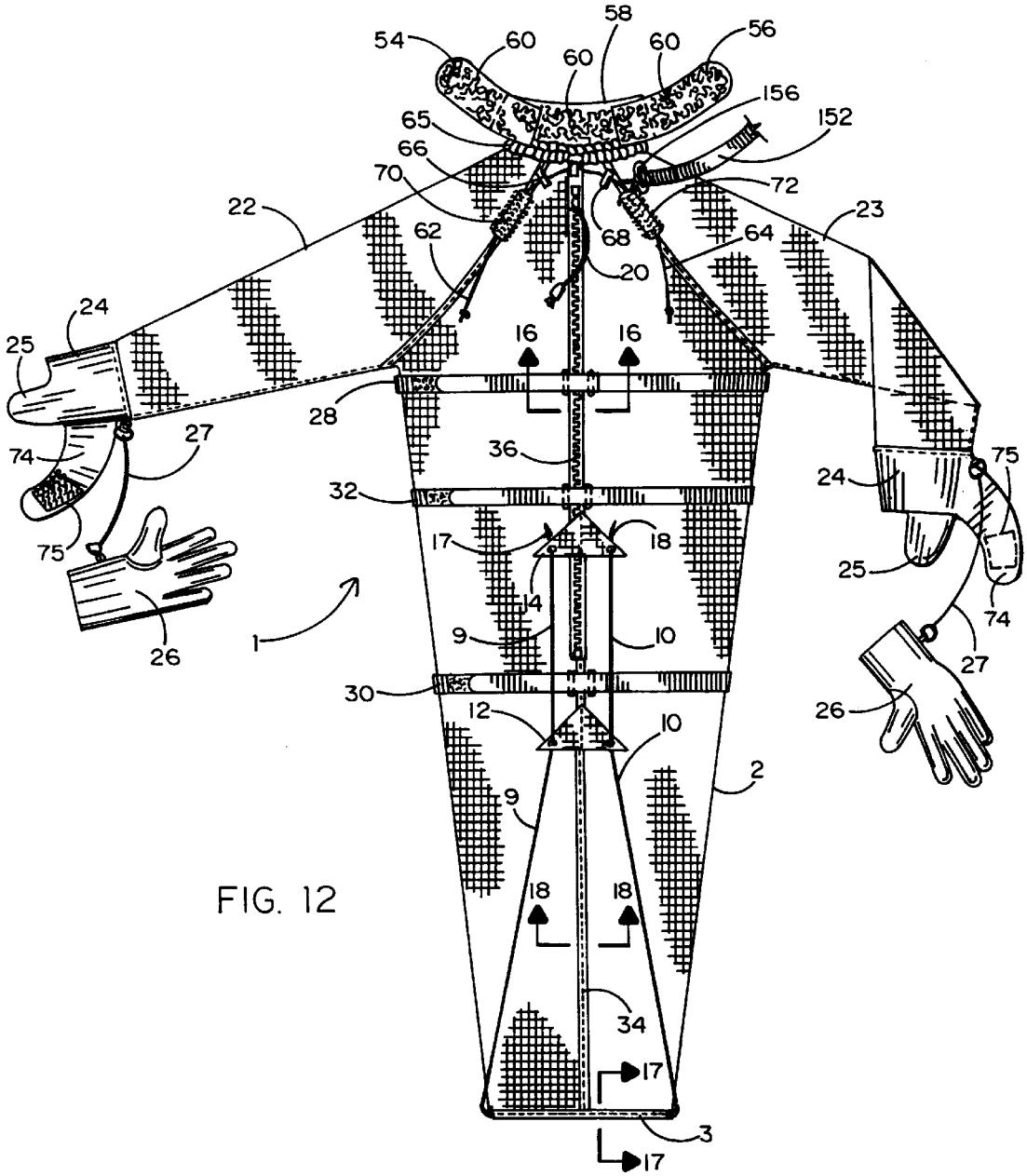
FIG. 12 shows the protective body heat retaining pod in an unfolded condition after it is removed from the pod containment envelope of FIGS. 4 and 5 so as to be used to enable a wearer to prolong his survival in a cold water environment while awaiting rescue.
Figure 13:
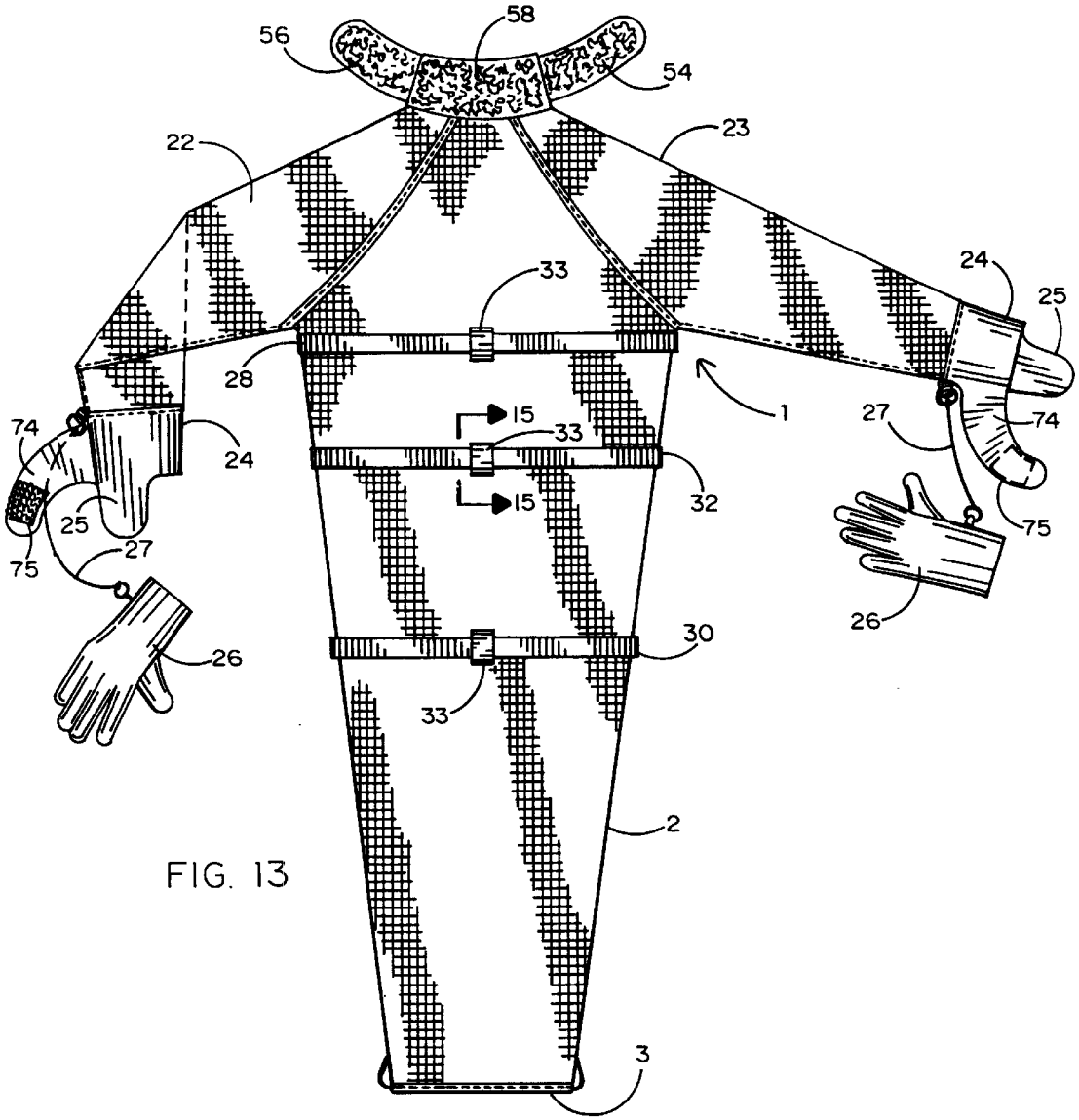
FIG. 13 shows the back of the protective pod of FIG. 12.

In this regard, when it is desirable to shorten the length of the body portion 2 of protective pod 1 from the elongated configuration of FIGS. 12 and 13 and thereby enable the wearer to assume the fetal position of FIG. 14, the wearer depresses the push button of a cord stopper 17 or 18 at the same time that he pulls upwardly on the cinching cord 9 or 10, whereby the cinching cord slides upwardly through guide tabs 12 and 14 to shorten the distance between the closure 3 and the upper guide tab 14. That is to say, the pulling force applied to the cinching cords 9 and 10 is transferred to the closure 3 to cause the bottom of the body portion 2 of pod 1 to be correspondingly pulled upwardly, whereby the wearer's legs are drawn into the fetal position at which to advantageously reduce the empty space within chamber 40 so as to inhibit the loss of the wearer's body heat. The push button of the cord stopper 17 or 18 is then released so that the jaws thereof resume their original clamping force against the cinching cord 9 or 10 to prevent the cinching cord from sliding downwardly through the guide tabs 12 and 14 to extend the protective pod 1 to the elongated configuration shown in FIGS. 12 and 13. An additional benefit of holding the protective pod 1 in the shortened configuration of FIG. 14 is to enable the wearer to maintain the fetal position without having to unnecessarily exert energy and thereby speed up the loss of his body heat.

Extending outwardly and in opposite directions from the body portion 2 of protective pod 1 are a pair of sleeves 22 and 23. As is best shown in FIGS. 12 and 13, each sleeve 22 and 23 is affixed (e.g. stitched) to the body portion 2 along a diagonal seam. A cylindrical cuff 24 that is manufactured from a resilient (e.g. neoprene) material is affixed (e.g. stitched) to the end of each sleeve 22 and 23. The cuffs 24 are covered with loop fastener material. A tongue 25 projects axially outward, and a wrist wrap 74 projects radially outward from each cylindrical cuff 24. A pad 75 covered with hook fastener material is affixed to the end of each wrist wrap 74.

Figure 19A:
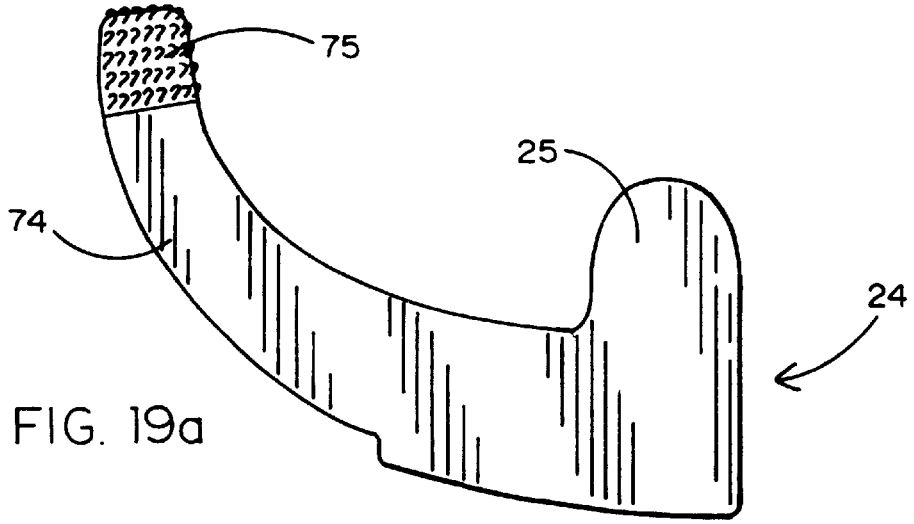
FIG. 19 shows details of a watertight cuff attached at the end of each of the sleeves of the protective body heat retaining pod which receive the arms of the wearer.
Figure 19B:
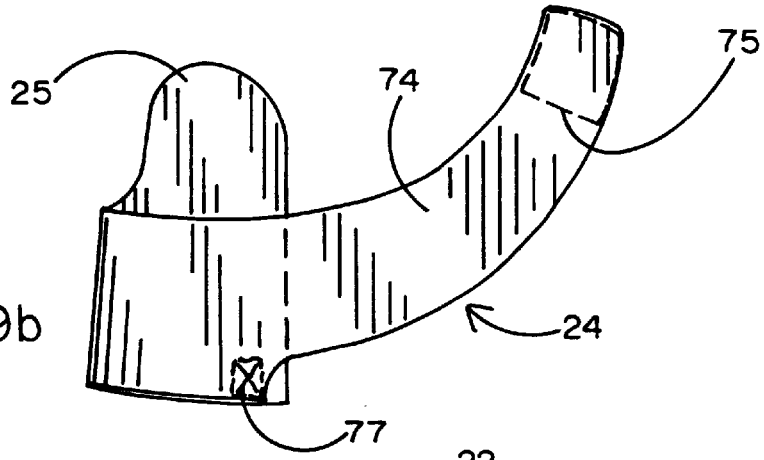
Figure 19C:
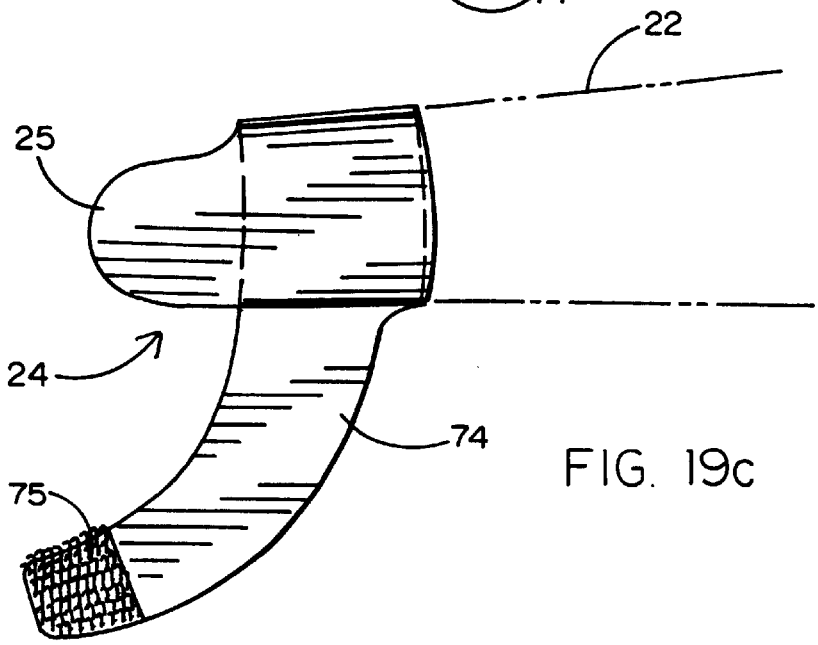

As is best shown in FIGS. 19A–19C of the drawings, the aforementioned cuff 24 is initially cut from a flat piece of resilient material covered with loop fastener material and having the tongue 25 and wrist wrap 74 extending coextensively from one another and forming an approximate right angle (FIG. 19A). The pad 75 of hook fastener material is located on one side and at the tip of wrist wrap 74. The wrist wrap 74 is rolled over the tongue 25 to establish a generally cylindrical cuff configuration through which to receive the hand and surround the wrist of the wearer. The wrist wrap 74 is retained in the cylindrical configuration over top of the tongue 25 by means of a single box stitch 77 (FIG. 19B). Finally, the cylindrical portion of the cuff 24 is stitched to the open end of one of the sleeves (e.g. 22) which extend from the protective pod 1. A cuff which is a mirror image of the cuff 24 shown in FIG. 19 is then stitched to the other sleeve 23.

Figure 20:
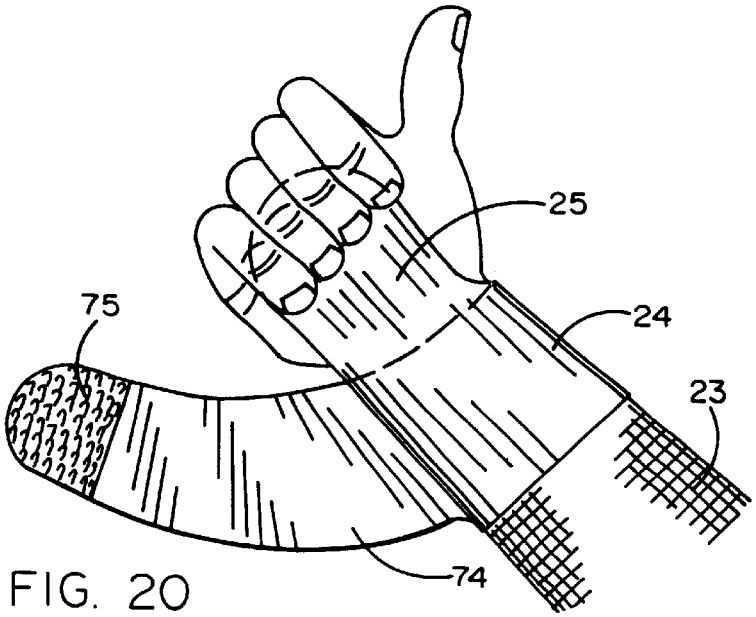
FIGS. 20–22 illustrate the steps by which the cuff shown in FIG. 19 is used to prevent water from entering the protective body heat retaining pod via the sleeves thereof.
Figure 21:
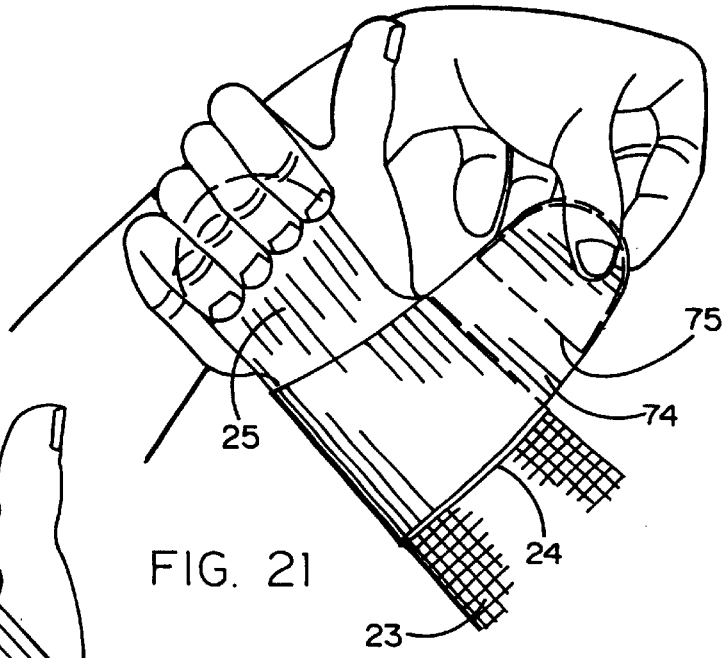
Figure 22:
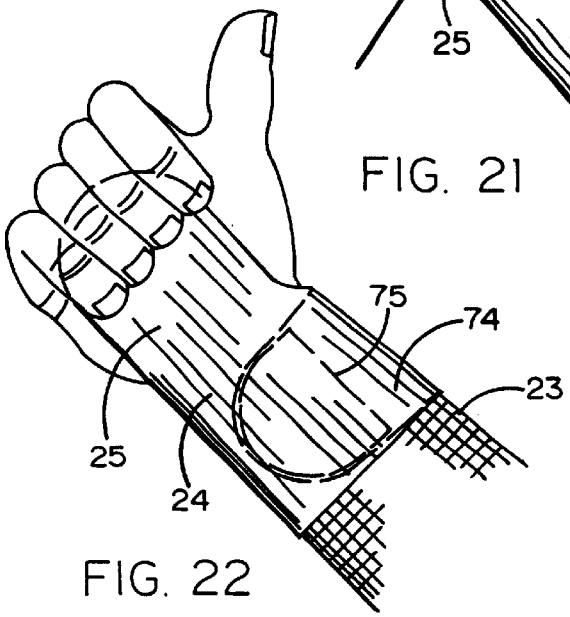

The use of the resilient cuffs 24 to prevent sea water from entering the body portion 2 of protective pod 1 via sleeves 22 and 23 is now described while referring concurrently to FIGS. 19–21. When the wearer don's the pod 1, his arms are received through the sleeves 22 and 23 so that his wrists are surrounded by the cylindrical cuffs 24 and his hands lie flush against the axially projecting tongues 25 of cuffs 24 (best shown in FIG. 19). With one hand holding the tongue 25 of a first of the cuffs 24, the wearer grasps the radially projecting wrist flap 74 with his other hand (best shown in FIG. 20). While continuing to hold the tongue 25 (to prevent the cuff from rotating around his wrist), the wearer pulls the wrist wrap 74 and winds it snugly around the cuff 24.

The wrist wrap 74 is wound up around itself and over the cuff 24 until the pad 75 that is covered with the hook fastener material is moved into mating engagement with the loop fastener material with which the cuff 24 is covered (best shown in FIG. 21). Accordingly, with the wrist wrap 74 wound securely around itself and tightened against the wearer's wrist, a reliable closure is established by which to prevent water from the wearer's environment from entering the sleeves 22 and 23. In this regard, the same method as just described is repeated for the other one of the cylindrical cuffs 24 to maintain the substantially watertight characteristic of the protective body heat retaining pod 1 surrounding the wearer.

A pair of conventional diver's wet suit gloves 26, or the like, are connected to the cuffs 24 by means of tethers 27. After the wrist wraps 74 are securely wrapped around the cuffs 24, the gloves 26 are donned while still attached to their tethers 27. The wearer fits his hands into the gloves 26, whereby the gloves extend over the cuffs 24 to warm the wearer's hands (best shown in FIG. 14).

Figure 16:
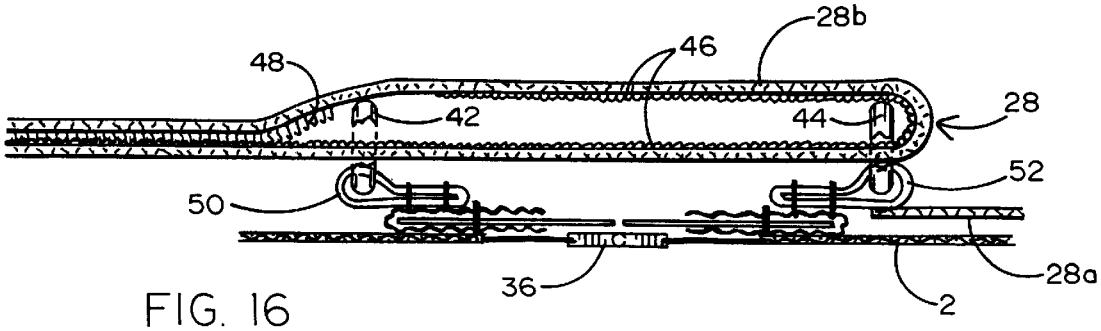
FIG. 16 is a cross-section taken along lines 16—16 of FIG. 12.

The body portion 2 of protective pod 1 includes upper, lower and intermediate cinching straps 28, 30 and 32 which extend horizontally therearound. As is best shown in FIGS. 13 and 16, the horizontally extending cinching straps 28, 30 and 32 are held in uniform spaced alignment with one another by means of belt loops 33 sewn to the back of the body portion 2 of the protective pod 1. As is best shown in FIG. 12, the area of the body portion 2 of protective pod 1 lying below the lower cinching strap 30 is permanently sealed by means of a stitched seam 34 that runs vertically along the front of the body portion 2 to form the watertight chamber 40 (of FIG. 14) within which to receive the wearer's legs and in which a small volume of water from the wearer's environment is trapped so as to be heated by the wearer's body heat. The area of the body portion 2 of protective pod 1 lying above the lower cinching strap 30 can be either closed or opened by means of a vertically extending, commercially available water tight zipper 36. When the zipper 36 is opened, the wearer will be able to climb into (or out of) the protective pod 1 whether the wearer is located on dry land or in a cold water environment. The zipper 36 is then closed to preserve the water tight chamber 40 within the body portion 2. A pull string (designated 20 in FIG. 12) is attached to the zipper to facilitate its being lowered or raised by the wearer.

Each of the upper, lower and intermediate cinching straps 28, 30 and 32 is provided with an identical closure means by which to hold the body portion 2 of protective pod 1 in snug engagement with the wearer's waist and chest to further reduce the size of the chamber 40 within which water is trapped. Referring to FIG. 16, details of the closure means for the upper, lower and intermediate cinching straps 28, 30 and 32 are now described. A pair of conventional plastic D-rings 42 and 44 are attached to the front of the body portion 2 by means of respective flexible loops 50 and 52 so that the D-rings are spaced across from one another at opposite sides of the vertically extending zipper 36. One end (designated 28*a* in FIG. 16) of each cinching strap (e.g. 28) is fixedly attached to the body portion 2 at loop 52. The opposite free end (designated 28*b* in FIG. 16) of the cinching strap 28 is covered with adjacent regions 46 and 48 of complementary hook and loop fastener material extending along one side thereof.

Once the wearer has climbed into the protective body heat retaining pod 1, the zipper 36 is closed and the opposing fixed and free ends 28*a* and 28*b* of cinching strap 28 are joined together. More particularly, the free end 28*b* of the cinching strap 28 is pulled through the side-by-side pair of D-rings 42 and 44 so as to extend across the zipper 36. The free end 28*b* of the cinching strap 28 along which the adjacent regions 46 and 48 of hook and loop fastener material are located is then turned back upon itself and folded over the top of each of the D-rings 44 and 42. The free end 28*b* of the cinching strap 28 is then pulled in a direction away from the fixed end 28*a* at loop 52 so as to eliminate slack and ensure a tight fit across the zipper 36 and around the body portion 2. Next, the folded over free end 28*b* of the cinching strap is laid over itself at which time the adjacent regions 46 and 48 of hook and loop fastener materials are detachably mated together to hold the fixed and free ends 28*a* and 28*b*.

The aforementioned tightening process as just described for the upper cinching strap 28 is repeated for the lower and intermediate cinching straps 30 and 32. When all of the cinching straps 28, 30 and 32 are snugly wrapped and closed around the protective pod 1 as shown in FIG. 14, the body portion 2 thereof will be compressed against the wearer's body to minimize the size of the sealed chamber 40 so as to reduce the volume of water in the body portion 2 that must be heated by the wearer's body heat to advantageously slow the drop of his body temperature while awaiting rescue. In addition, the previously described fetal position assumed by the wearer by means of pulling on the cinching straps 9 and 10 of FIG. 12 further reduces the heat loss and prolongs the wearer's ability to survive in the cold water environment.

Returning to FIGS. 12 and 13, in order to assure that sea water from the wearer's environment outside of the protective pod 1 does not undesirably enter the body portion 2 and at the same time increase the volume of water trapped within the sealed chamber 40, the protective pod 1 is provided with an elongated wrap around collar that is manufactured from a resilient (e.g. neoprene) material that is adapted to be stretched when pulled. The collar has first and second flap members 54 and 56 that project outwardly and in opposite directions from a neck support member 58. The wrap around pod collar is manufactured so that each of the first and second flap members 54 and 56 and the neck support member 58 thereof includes an integral component of loop fastener material 60.

Opposite free ends 62 and 64 of a drawstring are available at the front of the body portion 2 of protective pod 1 below the wrap around pod collar. The drawstring runs through a channel 65 that extends around the neck of the body portion 2. Thus, when the opposite ends 62 and 64 of the drawstring are pulled, the channel 65 of the body portion 2 will be tightened around the collar 130 of the lifejacket 100 that is worn below the pod. Each free end 62 and 64 of the drawstring is associated with a cord stopper 66 and 68 to prevent the free ends 62 and 64 from sliding inwardly of the channel 65 once the free ends 62 and 64 are pulled to tighten the channel 65 of body portion 2 around the collar 130 of lifejacket 100. In addition, each of the free ends 62 and 64 of the drawstring are received through an elongated loop or tunnel 70 and 72 that is covered with hook fastener material.

Once the wearer has pulled the hood (designated 160 in FIGS. 10 and 11) from the lifejacket 100 over his head, donned the protective body heat retaining pod 1, moved the watertight zipper 36 vertically upward to the closed position, secured the watertight wrist wraps 74 around cuffs 24, adjusted the length of cinching cords 9 and 10, fastened the cinching straps 28, 30 and 32, and pulled the free ends 62 and 64 of the drawstring to tighten the channel 65 around the collar 130 of lifejacket 100, he is ready to wrap the pod collar around his neck in the manner shown in FIG. 14. The wearer grasps one of the first or second resilient collar flap members 54 and 56 that is manufactured with loop fastener material 60 and stretches it diagonally across his body to be detachably connected to one of the loops 70 and 72 that is covered with hook fastener material. Next, the wearer grasps the other one of the first or second collar flap members 54 and 56 and stretches it diagonally across his body to be detachably connected to the other loop 70 and 72. Accordingly, as is best shown in FIG. 14, the first and second collar flap members 54 and 56 of the pod collar cross over one another above the wearer's chest and in front of the wearer's neck to complete the water tight closure of the pod 1 around the neck of the wearer.

As was previously described when referring to FIGS. 6–11, the back of the hood 160 that is pulled from the foldover collar 130 of lifejacket 100 is provided with a strip 168 of hook fastener material extending therearound. When the wearer stretches the first and second flap members 54 and 56 of the wrap around pod collar across his body as shown in FIG. 14, the layer 60 of loop fastener material which covers the neck support member 58 of the pod collar is moved into mating engagement with the strip 168 of complementary hook fastener material of the hood 160, whereby the wrap around pod collar is securely attached to the back of the hood 160.

Figure 17:
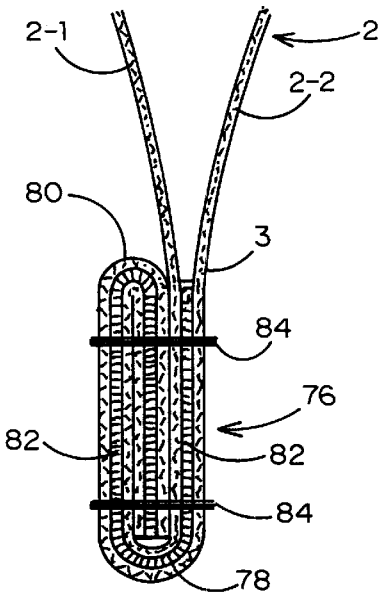
FIG. 17 is a cross-section taken along FIG. 17—17 of FIG. 12.
Figure 18:
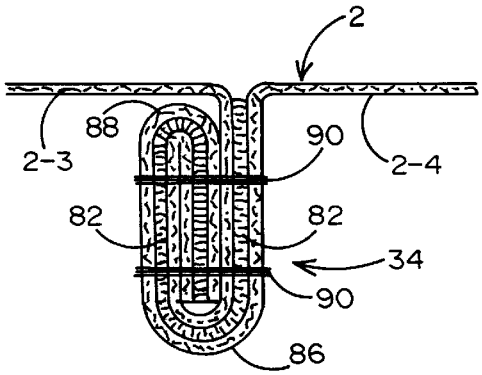
FIG. 18 is a cross-section taken along FIG. 18—18 of FIG. 12.

FIGS. 17 and 18 of the drawings illustrate the manner in which the protective body heat retaining pod 1 is manufactured so as to create a substantially watertight enclosure to surround the wearer who awaits his rescue in a cold water environment. FIG. 17 refers to a horizontal seam 76 that seals the closure 3 running along the bottom of body portion 2. FIG. 18 refers to the vertical seam 34 running along the front of body portion 2. Although only two seams 34 and 76 are shown and described, it is to be understood that all of the seams of the protective pod 1 are created in the manner illustrated by either one of FIGS. 17 and 18 and are therefore provided with the same advantages.

To create the seam 76 of FIG. 17, the front and back sides (designated 2-1 and 2-2) of the bottom of the body portion 2 of pod 1 are brought together in face-to-face alignment with one another. The face-to-face alignment of the front and back sides 2-1 and 2-2 is turned a first time to establish a first fold 78 and then a second time in the same direction so as to lie under the first fold 78 and establish a second fold 80. A commercially available thermal bonding material 82, such as that manufactured by 3M Company under the trademark THERMO-BOND FILM, is applied between the opposite facing front and back sides 2-1 and 2 —2 of body portion 2 that undergo the first and second folds 78 and 80. Finally, the folds 78 and 80 of the front and back sides 2-1 and 2-2 of body portion 2 are sewn together by means of parallel lock stitches 84 whereupon the seam 76 will be held closed. With the application of sufficient heat and pressure, the thermal bonding material 82 covers the holes created by the stitches 84 and helps to preserve the watertight seal along the closure 3.

In the case of the seam 34 of FIG. 18, opposing vertical edges (designated 2-3 and 2-4) at the front of body portion 2 of protective pod 1 are brought together in face-to-face alignment. The face-to-face alignment of opposing edges 2-3 and 2-4 is turned a first time to establish a first fold 86 and then a second time under the first fold 86 to establish a second fold 88. As with the seam 76 for the closure 3 of FIG. 17, a thermal bonding material 82 is applied between the opposite facing edges 2-3 and 2-4 of body portion 2 that undergo the first and second folds 86 and 88. Also like the seam 76, the folds 86 and 88 of the opposite vertical edges 2-3 and 2-4 of body portion 2 are sewn together by means of parallel lock stitches 90 whereupon the seam 34 will also be held closed.

It may now be appreciated that the seams 34 and 76 of FIGS. 17 and 18 are twice folded so as to lie outside (i.e. above) the body portion 2 of protective pod 1. Accordingly, the seams 34 and 76 are sized and located to create external attachment points for the guide tabs 12 and 14, and the like, whereby to advantageously avoid leakage in order to maintain the water resistant nature of the seams 34 and 76 and preserve the substantially watertight quality of pod 1.

By virtue of the foregoing, the wearer is now fully enclosed by a virtually watertight protective body heat retaining pod 1 which is used in combination with the lifejacket 100 to keep him afloat in a cold water environment while reducing the loss of life sustaining body heat and prolonging the time to avoid hypothermia, whereby to increase the wearer's chances for surviving and being rescued from an otherwise life threatening emergency situation.

Although the combination life jacket 100 and protective body heat retaining pod 1 have been described above for use by a wearer who finds himself within a cold water environment, this combination may also be used by those outside of water who seek protection from the elements while awaiting their rescue from an emergency and possibly life threatening situation (e.g. including those in a boat floating at sea or lost in the wilderness).

I claim:

1. In combination:

a lifejacket to be worn to enable a wearer to survive an emergency situation in a body of water, said lifejacket having a pod containment envelope comprising a plurality of flaps that are folded together to form an enclosure;

a protective body heat retaining pod adapted to be folded into a compact package to be carried within said pod containment envelope of said lifejacket and removed from said pod containment envelope and unfolded so as to be worn over said lifejacket to surround the wearer who finds himself within the body of water while awaiting rescue; and a rip cord attached to at least one of said plurality of flaps of said pod containment envelope, such that a pulling force applied to said rip cord causes said plurality of flaps to be unfolded to thereby permit the wearer to gain access to said protective body heat retaining pod carrier within said containment envelope.

2. The combination recited in claim 1, including a detachable tether by which said protective body heat retaining pod is coupled to said lifejacket.

3. The combination recited in claim 1, including a hood affixed to said lifejacket and adapted to be pulled over the head and around the face of the wearer, said hood carried in a rolled up condition within said lifejacket.

4. The combination recited in claim 3, said lifejacket having a fold over collar, said hood carried in the rolled up condition under said fold over collar, and said fold over collar being lifted up to permit the wearer to gain access to said hood carried therewithin.

5. The combination recited in claim 4, including complementary hook and loop fasteners which are detachably mated to one another to hold said fold over collar closed against said lifejacket to enable said hood to be carried therewithin in the rolled up condition, a first one of said hook and loop fasteners positioned on said fold over collar and the other one of said hook and loop fasteners positioned in opposite facing alignment therewith on said lifejacket.

6. The combination recited in claim 4, including complementary hook and loop fasteners which are detachably mated to one another in order to attach said hood to said protective body heat retaining pod when the wearer is surrounded by said pod, a first one of said hook and loop fasteners positioned on said hood and the other one of said hook and loop fasteners positioned in opposite facing alignment therewith on said protective body heat retaining pod.

7. The combination recited in claim 6, wherein said protective body heat retaining pod to surround the wearer has a front, a back and a wrap around collar located at said back to extend around said hood and over the fold over collar of said lifejacket to prevent water from entering the pod, the first one of said hook and loop fasteners positioned on the rear of said hood and the other one of said hook and loop fasteners positioned on the wrap around collar of said pod.

8. The combination recited in claim 7, wherein said wrap around collar has first and opposite flaps manufactured with the other one of said hook and loop fasteners, the first flap of said wrap around collar extending in a diagonal direction across and removably attached to the front of said protective body heat retaining pod, and the opposite flap of said wrap around collar extending in a diagonal direction across and removably attached to the front of said pod so as to cross over said first flap in front of the wearer's neck.

9. The combination recited in claim 1, wherein said protective body heat retaining pod surrounding the wearer has a sealed body portion that encloses the legs and torso of the wearer, said sealed body portion forming a chamber around the wearer in which to trap a small volume of water from the body of water in which the wearer finds himself so that the small volume of water can be warmed by the body heat of the wearer to slow the rate at which the body temperature of the wearer drops while waiting rescue.

10. The combination recited in claim 9, including at least one cinching cord attached to the sealed body portion of said protective body heat retaining pod and guide means for receiving and holding the position of said cinching cord, such that when the wearer pulls said cinching cord upwardly through said guide means, the sealed body portion is correspondingly pulled upwardly to draw and hold the wearer's legs in a fetal position in order to reduce the size of the chamber of said body portion and minimize the volume of water to be trapped and heated therewithin.

11. The combination recited in claim 9, including a watertight zipper extending in a vertical direction along the sealed body portion of said protective body heat retaining pod by which to enable the wearer to don said pod and then seal said body portion around his legs and torso while forming said chamber within which said small volume of water is to be trapped and heated.

12. The combination recited in claims 9, including a plurality of body cinching straps extending in a horizontal direction around the sealed body portion of said protective body heat retaining pod, said body cinching straps adapted to be tightened against the wearer so as to hold said body portion snugly against the wearer to further reduce the size of the chamber of said body portion and further minimize the volume of water to be trapped and heated within said chamber.

13. The combination recited in claim 9, including a pair of sleeves attached to and projecting outwardly and in opposite directions from the sealed body portion of said protective body heat retaining pod to receive the arms of the wearer therethrough, and cuffs attached to respective ones of said pair of sleeves and adapted to be tightened around and closed against the wearer's arms to prevent water from entering said sealed body portion by way of said pair of sleeves.

14. The combination recited in claim 13, wherein each cuff has a cylindrical cuff body to surround the wearer's wrist, an axially projecting tongue to be held by the wearer to prevent the cuff body from rotating around the wearer's wrist, and a radially projecting wrist wrap that is adapted to be wound around the cuff body and over itself, whereby the cuff body is tightened against the wearer's wrist to prevent water from entering the sleeve to which the cuff is attached.

15. The combination recited in claim 9, including a pair of gloves tethered to respective ones of said pair of sleeves to fit over the hands of the wearer.

16. The combination recited in claim 9, wherein the sealed body portion of said protective body heat retaining pod is sealed by at least one elongated seam comprising first and opposite ends of said body portion that are brought together in face-to-face alignment with one another, said face-to-face alignment being turned first and second times in the same direction to form first and second folds, and stitching applied through said first and second folds to hold said seam closed.

17. The combination recited in claim 16, including a thermal bonding material located between the face-to-face alignment of the first and opposite ends of said sealed body portion that form said first and second folds, such that applying heat and pressure to said thermal bonding material avoids the leakage of water through holes in said first and second folds created by said stitching.

18. In combination:

a lifejacket to be worn to enable a wearer to survive an emergency situation in a body of water, said lifejacket having a pod containment envelope; and a protective body heat retaining pod adapted to be folded into a compact package to be carried within said pod containment envelope of said lifejacket and removed from said pod containment envelope and unfolded so as to be worn over said lifejacket to surround the wearer who finds himself within the body of water while awaiting rescue, said protective body heat retaining pod surrounding the wearer and having a sealed body portion that encloses the legs and torso of the wearer, said sealed body portion forming a chamber around the wearer in which to trap a small volume of water from the body of water in which the wearer finds himself so that the small volume of water can be warmed by the body heat of the wearer to slow the rate at which the body temperature of the wearer drops while waiting rescue, and said protective body heat retaining pod also having at least one cinching cord attached to the sealed body portion of said protective body heat retaining pod and guide means for receiving and holding the position of said cinching cord, such that when the wearer pulls said cinching cord through said guide means, the sealed body portion is pulled upwardly to draw and hold the wearer's legs in a fetal position in order to reduce the size of the chamber of said body portion and minimize the volume of water to be trapped and heated therewithin.

19. The combination recited in claim 18, including a watertight zipper extending in a vertical direction along the sealed body portion of said protective body heat retaining pod by which to enable the wearer to don said protective pod and then seal said body portion thereof around his legs and torso while forming said chamber within which said small volume of water is to be trapped and heated.

20. The combination recited in claim 18, including a plurality of body cinching straps extending in a horizontal direction around the sealed body portion of said protective body heat retaining pod, said body cinching straps adapted to be tightened against the wearer so as to hold said body portion snugly against the wearer to further reduce the size of the chamber of said body portion and further minimize the volume of water to be trapped and heated within said chamber.

21. The combination recited in claim 18, including a pair of sleeves attached to and projecting outwardly and in opposite directions from the sealed body portion of said protective body heat retaining pod to receive the arms of the wearer therethrough, and cuffs attached to respective ones of said pair of sleeves and adapted to be tightened around and closed against the wearer's arms to prevent water from entering said sealed body portion by way of said pair of sleeves.

22. The combination recited in claim 21, wherein each cuff has a cylindrical cuff body to surround the wearer's wrist, an axially projecting tongue to be held by the wearer to prevent the cuff body from rotating around the wearer's wrist, and an elastic wrist wrap that is adapted to be pulled around the cuff body and wound over itself, whereby said elastic wrist wrap is tightened against the wearer's wrist above the cuff body to prevent water from entering the sleeve to which the cuff is attached.

23. The combination recited in claim 21, including a pair of gloves tethered to respective ones of said pair of sleeves to fit over the hands of the wearer.

24. The combination recited in claim 18, wherein the sealed body portion of said protective body heat retaining pod is sealed by at least one elongated seam comprising first and opposite ends of said body portion that are brought together in face-to-face alignment with one another, said face-to-face alignment being turned first and second times in the same direction to form first and second folds, and stitching applied through said first and second folds to hold said seam closed.

25. The combination recited in claim 24, including a thermal bonding material located between the face-to-face alignment of the first and opposite ends of said sealed body portion that form said first and second folds, such that applying heat and pressure to said thermal bonding material seals the holes in said first and second folds created by said stitching.

26. In combination:

a lifejacket to be worn to enable a wearer to survive an emergency situation in a body of water, said lifejacket having a pod containment envelope; and a protective body heat retaining pod adapted to be folded into a compact package to be carried within said pod containment envelope of said lifejacket and removed from said pod containment envelope and unfolded so as to be worn over said lifejacket to surround the wearer who finds himself within the body of water, said lifejacket having a hood attached thereto and adapted to be pulled over the head and around the face of the wearer, and said protective body heat retaining pod having a front, a back and a wrap around collar located at the back and extending around said hood to the front so as to prevent water from entering said protective pod.

27. The combination recited in claim 26, wherein said wrap around collar has first and opposite flaps, the first flap of said wrap around collar extending in a diagonal direction across and removably attached to the front of said protective body heat retaining pod, and the opposite flap of said wrap around collar extending in a diagonal direction across and removably attached to the front of said protective pod so as to cross over said first flap in front of the wearer's neck and thereby establish a water-tight seal around the front of the wearer's neck.

28. The combination recited in claim 26, including complementary hook and loop fasteners which are detachably mated to one another in order to attach said wrap around collar to said hood when the wearer is surrounded by said protective pod, a first of said complementary hook and loop fasteners positioned on said hood and the other one of said complementary hook and loop fasteners positioned in opposite facing alignment therewith on said wrap around collar.

29. The combination recited in claim 26, wherein said hood attached to said life jacket is carried in a rolled up condition, said lifejacket having a fold over collar, said hood carried in the rolled up condition under said fold over collar, and said fold over collar being lifted up and off said lifejacket to permit the wearer to gain access to said hood carried thereunder.

30. The combination recited in claim 29, including complementary hook and loop fasteners which are detachably mated to one another to hold said fold over collar closed against said lifejacket to enable said hood to be carried thereunder in the rolled up condition, a first of said complementary hook and loop fasteners positioned on said fold over collar and the other one of said complementary hook and loop fasteners positioned in opposite facing alignment therewith on said lifejacket.

* * * * *